United States Patent [19]

Angus

[11] 4,002,127

[45] Jan. 11, 1977

[54] CYCLONE STRUCTURE

[76] Inventor: Derek Angus, 727 Galloway Crescent, London, Ontario, Canada

[22] Filed: Mar. 13, 1975

[21] Appl. No.: 558,095

[52] U.S. Cl. ..... 110/8 C; 110/18 C; 110/28 F

[51] Int. Cl.[2] ..... F23G 5/12; F23D 1/02

[58] Field of Search ..... 110/8 R, 8 C, 18 R, 110/18 C, 28 F; 122/235 P

[56] References Cited

UNITED STATES PATENTS

| | | | |
|---|---|---|---|
| 2,707,444 | 5/1955 | Vanloon | 110/28 |
| 2,907,288 | 10/1959 | Blomquist | 110/28 |
| 3,179,150 | 4/1965 | Arnold | 110/28 |
| 3,727,563 | 4/1973 | Hasselbring et al. | 110/8 |

FOREIGN PATENTS OR APPLICATIONS

| | | | |
|---|---|---|---|
| 1,024,192 | 2/1958 | Germany | 110/28 |
| 1,011,113 | 6/1957 | Germany | 110/28 |

*Primary Examiner*—Kenneth W. Sprague
*Attorney, Agent, or Firm*—Ian Fincham; Stanley D. Schwartz

[57] ABSTRACT

A cyclone structure is provided for use in controlling the flow of two fluid streams to create a localized inward radial flow. The structure includes a chamber having a side wall disposed concentrically about a longitudinal axis and having first and second transverse end walls attached to respective ends of the side wall. A discharge tube is mounted in the first end wall concentrically about this axis and projects into the chamber. First and second inlets are provided adjacent the respective end walls and means is provided to move fluid under pressure into these inlets and into the chamber. The fluid enters the chamber in two distinct fluid paths moving vortically about the axis in the same direction of rotation, and the respective energy flow rates of fluid in these paths are comparable. The paths are generally vortical within the chamber and progress axially towards one another before combining where they meet to create the localized inward radial flow. Subsequently, the fluid leaves the radial flow and moves axially towards and out through the discharge tube. A method of providing the radial flow is also described.

15 Claims, 3 Drawing Figures

CYCLONE STRUCTURE

This invention relates to the creation of a radial flow path in a cyclone structure for use in apparatus such as cyclone furnaces, cyclone mixing devices, and cyclone particle separators.

Cyclone structures have been used in the past for various purposes and they can be classified according to the fluid path through the structure. Firstly, there are those structures which are essentially cylindrical and which have an inlet in a side wall adjacent one end. Fluid enters the inlet and proceeds in a vortical fashion along the cylindrical inner wall of the structure before leaving via a central axial outlet at the other end of the structure. Examples of patents showing structures using this flow are U.S. Pat. Nos. 3,727,563, 3,727,562, 3,757,707, 3,710,558, and 3,119,476.

A second cyclone structure uses a flow path which originates from one end of the structure and discharges from the same end. Accordingly, fluid entering the inlet moves vortically along a cylindrical inner wall before meeting an end wall whereupon the path is deflected radially inwards and turned through 180 degrees before passing axially to a central outlet at the same end as the inlet. This compound cyclonic flow is used in structures described in U.S. Pat. Nos. 3,096,275, 3,283,480, 2,881,720, 2,881,719 and 2,207,444.

It has been found that a cyclonic flow can be provided which has a variable path and which has advantages in many structures such as furnaces, mixing devices, and separators. Essentially, a radial flow is provided intermediate the ends of a cyclone structure and this radial flow can be moved axially with reference to the ends of the structure for various purposes.

Accordingly, in one of its aspects, the present invention provides a cyclone structure for use in controlling the flow of two fluid streams to create a localised inward radial flow. The structure includes a chamber having a side wall disposed concentrically about a longitudinal axis and having first and second transverse end walls attached to respective ends of the side wall. A discharge tube is mounted in the first end wall concentrically about this axis and projects into the chamber. First and second inlets are provided adjacent the respective end walls and means is provided to move fluid under pressure into these inlets and into the chamber. The fluid enters the chamber in two distinct fluid paths moving vortically about the axis in the same direction of rotation, and the respective energy flow rates of fluid in these paths are comparable. The paths are generally vortical within the chamber and progress axially towards one another before combining where they meet to create the localised inward radial flow. Subsequently, the fluid leaves the radial flow and moves axially towards and out through the discharge tube.

In another of its aspects, the invention provides a method of creating a radial flow from two distinct supplies of fluid. The method includes the steps of creating a first vortical flow from a first of the supplies of fluid such that the flow progresses along a longitudinal axis, and simultaneously creating a second vortical flow from a second of the supplies of fluid. This second vortical flow moves in the same direction about the axis and has an energy flow rate comparable to that of the first vortical flow. The second vortical flow progresses along the axis in the opposite direction to that of the first vortical flow and the first and second vortical flows are permitted to meet while preventing outward movement of the flows to thereby create a localised inward radial flow. Discharge from the inward radial flow is provided by an axial flow within one of the first and second vortical flows.

It is also within the scope of the invention to provide mixing devices, furnaces, and separators incorporating the aforementioned radial flow.

The invention will be better understood with reference to the drawings, in which.

Figure 1:
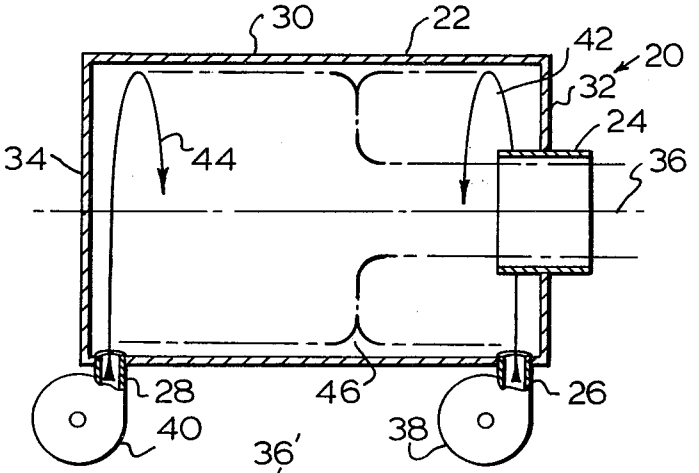
FIG. 1 is a diagrammatic view of a longitudinal section of a preferred embodiment of a cyclone structure according to the invention.

Reference is first made to FIG. 1 which shows a cyclone structure 20 consisting of a chamber 22, discharge tube 24, and respective inlets 26, 28.

The chamber consists essentially of a cyclindrical side wall 30 terminating at an annular end wall 32 surrounding the discharge tube 24, and a circular end wall 34. The side wall 30 is concentric about a longitudinal axis indicated by the numeral 36 and the discharge tube 24 is also concentric about this axis. End walls 32 and 34 are transverse with respect to the axis and the inlets 26, 28 are positioned in the side wall 30 to create vortical flow within the chamber 22. This is achieved in conventional fashion by arranging for the inlets to be substantially tangential with respect to the circular circumference of the side wall 30. As shown in FIG. 1, the inlets 26, 28 are substantially parallel to one another.

The principle of operation will be described with reference to FIG. 1 and it will be assumed that a pair of fans 38, 40 coupled to respective inlets 26, 28 are blowing air through these inlets to create two distinct vortical flows which rotate in the same direction about axis 36. It will be understood that the definition of the vortical flows rotating in the same direction about the axis means that when the two individual flows meet, they are cocurrent.

The energy flow rates through the inlets are of comparable magnitude although they can be adjusted as will be described. Air from the fan 38 results in a vortical flow indicated by a curved arrow 42, and similarly, the fan 40 creates a vortical flow indicated by the arrow 44. Each of the vortical flows must progress axially due to the proximity with the respective end walls 32, 34. Consequently, these vortical flows will progress until they meet as indicated in chain dotted outline in FIG. 1. At the point where they meet, the axial components of the energy in the vortical flows are substantially equal so that there is an axial balance. However, the fluids in the respective flows must continue to move and consequently they will move radially inwards until they are deflected by a pressure build-up at the axis 36. The fluids will then have a free path through the discharge tube 24 as indicated in chain dotted outline in the tube 24.

It will be appreciated that the junction between the vortical paths 42 and 44 will have an external peripheral zone 46 which is substantially quiescent because it lies outside of the vortical paths where they become radial. Both the annular zone of reduced flow energy, and the radial flow effect can be used for various purposes as will be described.

The radial flow may of course have a less distinct pattern than that illustrated in FIG. 1. However, for the purposes of this description the term "radial flow" means any flow which moves radially inwards, lies in a relatively narrow band, and is stable so that it can be used with predictable results.

The position of the radial flow depends upon the energy flow rates of the air coming from each of the inlets 26, 28. In the event that the flow rate is adjusted so that there is an increase through the inlet 26 with respect to the inlet 28, then the radial path will move towards the inlet 28. Conversely, if the energy flow rate is increased through the inlet 28 with respect to the inlet 26, then the radial flow will move towards the inlet 26. It has been found that there is an inherent stability in the position of the radial flow once the adjustment is complete and consequently it would be possible to calibrate equipment to predict the position of the radial flow for particular fluids and flow rates.

The side wall 22 need not necessarily be strictly cylindrical. However it should be symmetrical around the axis 36 and any deviation from cylindrical must be within the practical confines of operability. Any shape which prevents the efficient creation of vortical paths and the subsequent combination of these paths into radial flow would be unsatisfactory.

The structure shown in FIG. 1 has been described with reference to air entering both inlets. It will be appreciated that any gaseous fluid can be substituted for one or both air inputs and that solid particles or particulates can be carried in the gaseous stream. Such inputs are within the scope of the term 'fluid' used in this description.

The FIG. 1 structure could also be used with two liquids with or without added solids. These are also within the scope of the term 'fluid' as used in this application, although it will be appreciated that the term does not include the use of a gaseous fluid in one inlet and a liquid in the other inlet.

The inventive concept of providing a radial fluid flow within a cyclone structure has numerous applications. An exemplary application is illustrated in FIG. 2 in which parts corresponding to those described with reference to FIG. 1 are given primed numerals.

Figure 2:
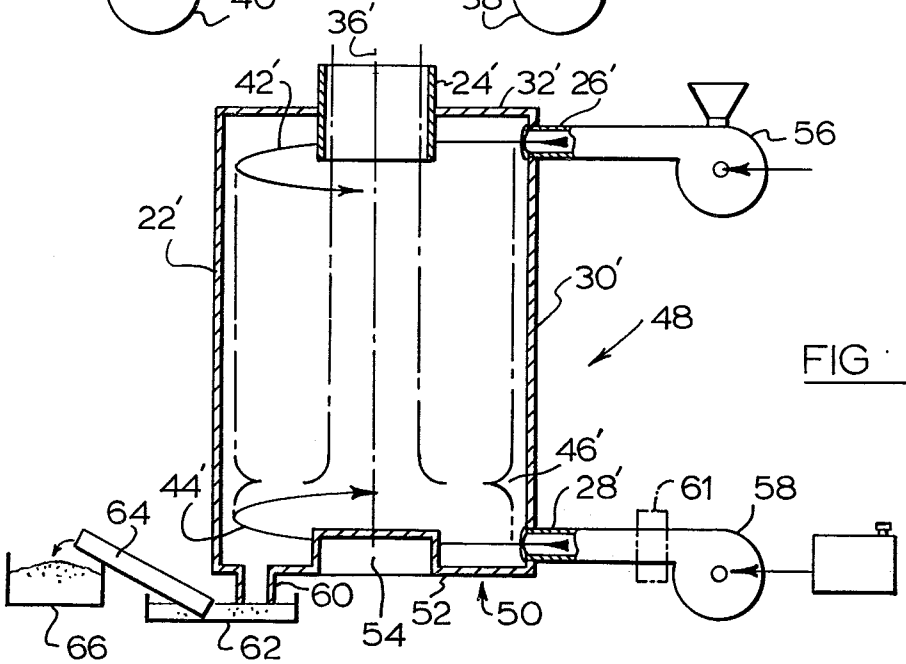
FIG. 2 is a view similar to FIG. 1 and illustrating an exemplary use of the cyclone structure in an incinerator arrangement.

As seen in FIG. 2, an incinerator 48 includes a chamber 22' which differs from the chamber 22 shown in FIG. 1 in that an end wall 50 is provided corresponding generally to end wall 34. End wall 50 has a generally annular section 52 surrounding an inset generally cylindrical portion 54. The purpose of this end wall is to collect slag as will be described.

The chamber 22' is in fact a combustion chamber in this structure and is arranged with axis 36' vertical. Primary air and waste material to be burned in the incinerator are fed from a feeder 56 through inlet 26' and proceed in the vortical path 42'. Similarly, secondary fuel and secondary air are moved by feeder 58 into vortical path 44'. The primary air and secondary air are fed in comparable energy rates so that a radial flow is created in a lower portion of the vertical combustion chamber 22'. Consequently, the primary air and waste fuel move along the inside wall of the chamber where they are heated by radiant heat emanating from exhaust gases passing axially upwards and out through the discharge tube 24'. The initial preheating continues until the primary air and lighter parts of the waste fuel begin to move radially where they combine with burning secondary fuel in an oxygen rich high temperature zone where the main combustion takes place. The combustion will continue for a portion of the distance travelled in the central path between the radial flow and the discharge tube 24'. Consequently it can be said that the incinerator includes a preheating zone where the waste fuel is heated as it moves downwardly, a main or secondary combustion zone where the movement is radial, and a tertiary combustion zone where final combustion takes place as the movement continues towards the discharge tube 24'.

When certain types of waste material is being incinerated, there is generally about 5 to 6 percent slag in the form of glass. This is melted in the incinerator mainly in the secondary combustion zone and falls towards the bottom of the incinerator. It is collected on the annular portion 52 of the end wall 50 and is allowed to exit through a discharge port 60 where it falls into a quenching bath 62. A spiral feeder 64 then transports the cold glass particles into a hopper 66.

The use of slag is advantageous in that it tends to collect fine particles which would otherwise be discharged through the tube 24'. Consequently when burning wood or other substances where no natural slag occurs, a synthetic slag (such as that collected in the hopper 66) is mixed with the solid fuel and fed through the inlet 26' to create a slag flow for collecting small particles.

The incinerator will of course be lined with fire resistance material as is common in the art. Also, the shape of the side wall 30' can be varied as was discussed with reference to FIG. 1. In particular it may be preferable to vary the shape of the side wall to take into consideration changes in volume of gases caused by heating.

In use, the quiescent zone 46' tends to collect heavier unburnt particles because their centrifugal force is greater than the drag which would otherwise carry them radially inwards. These unburnt particles will either be collected in the slag or they will rotate and break up and eventually be carried by the passing fluids into the main stream where they are burnt. Consequently, the arrangement tends to limit the possibility of unburnt heavier particles being discharged through the tube 24'. There is therefore a longer particle retention within the cyclone where particles would otherwise be lost without proper burning. Further, the length of the path followed by the solid fuel can be varied by changing the relative energy inputs between the inlets 26' and 28' as was discussed with reference to FIG. 1. For instance, if light material which burns readily is being incinerated, the time within the incinerator can be reduced by effectively moving the radial flow upwardly towards inlet 26'.

The incinerator is shown with the axis 36' vertical. However, this can be inclined towards the horizontal in which case the discharge port 60 would be positioned at a lower point in or adjacent the end wall 50 for ready discharge of the slag. It is also possible to have the axis 36' horizontal if a drainage trough is developed in the fire bricks in the side wall. However if a fuel is used which has no slag, the axis can be horizontal without special arrangements for disposing of liquid slag.

A further feature of the arrangement of the incinerator is that the extreme temperatures do not occur on the lining of the incinerator. Because of the flow of both the primary and secondary air, the major burning takes place in the radial flow. Consequently the largest temperatures tend to occur remote from the side wall. Also, where different fuels are used, the axial position of the radial flow will be adjusted in each case depending upon the time required for incineration. This will reduce local attrition at a particular part of the combustion chamber wall and enhance the life of the combustion chamber. In some instances the adjustment can be made cyclically to move the position of the radial flow continuously between limits. This is done by using a motor driven valve 61 on the fan inlet 28' as indicated in broken outline. The valve 61 can be in the form of a butterfly valve which when in the maximum throttling position causes the radial flow to reach a lower or minimum level and which when fully open causes the radial flow to reach an upper or maximum level. The effect of such a valve is twofold. Firstly the attrition of the fire wall is limited because the hottest parts are moving continuously, and secondly if slag builds up on the wall it will be cyclically heated to melt it and thereby clean the wall.

Yet another advantage is that slagging occurs in the hottest area. Cold primary air is preheated and involved in primary conbustion before it reaches the slagging zone. Consequently the primary air has little effect on cooling the slag so that there is less possibility that glass will solidify within the incinerator and will then have to be removed manually after the incinerator is cooled. This is an important aspect when handling waste materials with a high slag content.

Figure 3:
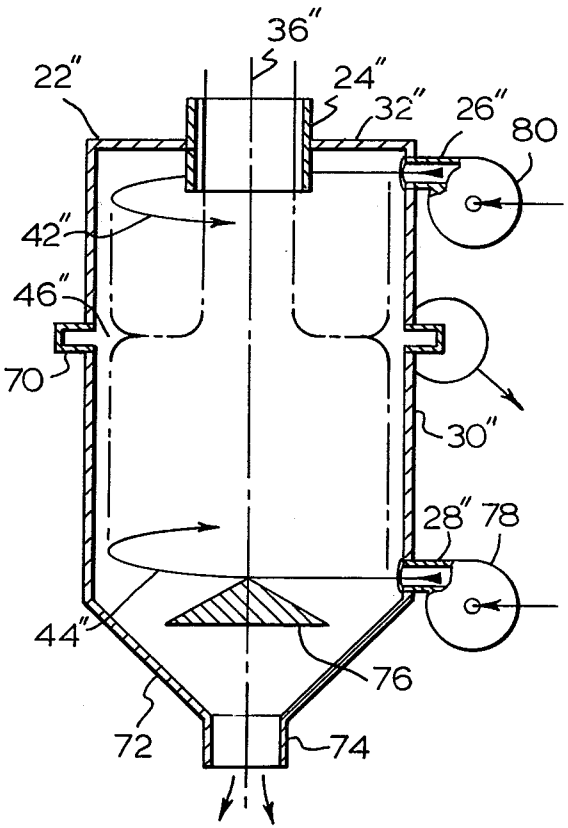
FIG. 3 is a view similar to FIG. 2 and illustrating the cyclone structure in use in a separator arrangement.

Reference is now made to FIG. 3 which illustrates a further exemplary use of the cyclone structure described with reference to FIG. 1. Parts shown in FIG. 3 which correspond to those used in FIG. 1 will be given double primed numerals. As seen in FIG. 3, axis 36'' is vertical and the side wall 30'' is interrupted by a scroll outlet 70 located for receiving particulates which are separated from an input as will be described.

The end of the chamber 22'' remote from the discharge tube 24'' differs from the corresponding end plates previously described. An end wall 72 is provided which has a frustro-conical profile and which terminates in a downward outlet tube 74. The end wall 72 and tube 74 are symmetrical about the axis 36''. Also, a conical baffle 76 is provided to encourage the formation of the vortical path 44''.

In use, a feeder 78 moves particulate laden fluid into the chamber 22'' by way of the inlet 28''. Heavier particles will immediately fall onto the end plate 72 and subsequently through the tube 74. Light and intermediate particles will remain in the fluid stream and follow vortical path 44''. Similarly, feeder 80 moves a control fluid through the inlet 26'' to create the vortical path 42''. Paths 42'' and 44'' meet at a radial flow aligned with the scroll outlet 70. Consequently, the intermediate particulates in the stream emanating from the feeder 78 will find their way to the quiescent zone 46'' and centrifugal force will carry them into the scroll outlet 70 while the light particles will be carried out through the discharge tube 24'' for separation in a filter.

What I claimed is:

1. An incinerator for burning waste products and the like, the incinerator comprising:

a combustion chamber having a side wall disposed concentrically about a longitudinal axis and having first and second transverse end walls attached to respective ends of the side wall;

a discharge tube mounted in the first end wall concentrically about said axis;

first and second inlets adjacent the respective end walls, the inlets being adapted to create two distinct vortical flows in the combustion chambers, the flows moving in the same direction about the axis;

means coupled to the first inlet and adapted to move said waste products and primary air through the first inlet and into the combustion chamber thereby creating a first generally vortical fluid path which progresses axially towards the second end wall;

means coupled to the second inlet and adapted to move secondary fuel and secondary air through the second inlet and into the combustion chamber thereby creating a second generally vortical fluid path which progresses axially towards the first end wall of the combustion chamber;

ignition means adapted to ignite the secondary fuel to cause combustion adjacent the second end wall; and said fluid paths meeting intermediate the end walls to create an inward radial flow path where the major portion of the combustion of the waste products takes place, the products of combustion then moving axially within the first fluid path before leaving the combustion chamber through the discharge tube, and the waste products and primary air being heated as they move towards the radial flow path by the products of combustion leaving the radial flow path.

2. An incinerator as claimed in claim 1 and further comprising means coupled to at least one of the first and second inlets for varying the energy rate of flow of the respective primary air and secondary air to thereby move the position of the radial flow axially of the chamber for changing the length of the path followed by the primary air and waste products in reaching the radial flow.

3. An incinerator as claimed in claim 2 in which the side wall is cylindrical.

4. An incinerator as claimed in claim 2 in which the incinerator further comprises a slag outlet positioned to permit gravitational flow of molten slag from the combustion chamber.

5. An incinerator as claimed in claim 3 in which the incinerator further comprises a slag outlet positioned to permit gravitational flow of molten slag from the combustion chamber, the incinerator further comprising a slag collection system for collecting reusable slag, the system comprising a water quench located adjacent the slag outlet, and means for collecting the quenched slag and storing this slag for future use with material which will not slag sufficiently to adequately control small particulates which otherwise produce dirty products of combustion.

6. A separator for removing particulates and the like from a fluid, the separator comprising:

a chamber having a side wall disposed concentrically about a longitudinal axis and having transverse end walls attached to respective ends of the side wall;

a discharge tube mounted in one end wall concentrically about said axis;

a pair of inlets, each inlet being adjacent a respective one of the end walls and adapted to create two distinct vortical flows in the chamber; the vortical flows moving in the same direction about the axis.

a particulate collection outlet attached to the side wall intermediate the end walls for channelling the particulates out of the chamber;

means coupled to one of the inlets and adapted to move a fluid carrying the particulates into the chamber through said one of the inlets and into the chamber in a first flow path, this flow path being generally vortical and progressing axially towards the other of said inlets;

means coupled to the other of the inlets and adapted to move a control fluid through said other of the inlets and into the chamber in a second flow path, this flow path being generally vortical and progressing axially to meet the first mentioned flow path thereby creating a localised radial flow and an annular quiescent zone about the radial flow, the flow paths combining into a single flow path in the radial flow, the single flow path then continuing from the radial flow to move axially towards and out through the discharge tube; and means coupled to at least one of the inlets to control the energy flow rate of a corresponding one of the particulate carrying fluid and the control fluid to thereby adjust the axial position of both the quiescent zone and the associated radial flow so that the quiescent zone is aligned with the particulate collection outlet for collecting particulates from the quiescent zone and thereby removing them from the separator.

7. A separator for removing particulates and the like from a fluid, the separator comprising:

a chamber having a side wall disposed concentricaly about a vertical longitudinal axis and having upper and lower end walls attached to respective ends of the side wall;

a discharge tube mounted in the upper end wall concentrically about said axis;

a first inlet adjacent the lower end wall and a second inlet adjacent the upper end wall;

a first particulate collection outlet mounted in the lower end wall for channelling heavier particulates out of the chamber;

a second particulate collection outlet attached to the side wall intermediate the upper and lower walls for channelling intermediate particulates out of the chamber;

means coupled to the first inlet and adapted to move a fluid carrying the particulates into the chamber through this inlet and into the chamber in a first flow path, the flow path being generally vortical and progressing axially upwards carrying the lighter particulates, the heavier particulates being left to fall under the influence of gravity out through the first particulate collection outlet;

means coupled to the upper inlet and adapted to move a control fluid through said upper inlet and into the chamber in a second flow path, this flow path being generally vortical in the same direction about the axis as the first flow path and progressing downwardly to meet the first mentioned flow path thereby creating a localised inward radial flow and an annular quiescent zone about the radial flow, the flow paths combining into a single flow path in the radial flow, the single flow path then continuing from the radial flow to move axially towards and out through the discharge tube; and means coupled to at least one of the inlets to control the energy flow rate of the respective particulate carrying fluid and the control fluid to thereby adjust the axial position of the quiescent zone and the radial flow so that the quiescent zone is aligned with the second particulate collection outlet for collecting the intermediate particulates from the quiescent zone and removing them from the separator while the light particulates are carried out through the discharge tube.

8. A separator as claimed in claim 6 in which the side wall is cylindrical.

9. A method of separating particulates from a particulate laden fluid comprising the steps:

creating a first vortical flow from said fluid, the flow progressing along a longitudinal axis;

creating a second vortical flow from a control fluid, the second vortical flow having an energy flow rate comparable to that of the first vortical flow and progressing along said axis in the opposite direction to that of the first vortical flow while rotating in the same direction about the axis;

permitting the respective first and second vortical flows to meet while preventing outward movement of the flows to thereby create a localised inward radial flow encompassed at the outer periphery thereof by a quiescent zone into which at least some of the particulates collect; and removing said some of the particulates through a collection outlet in said quiescent zone.

10. An incinerator as claimed in claim 2 in which the energy flow rate is varied cyclically by the flow rate varying means.

11. An incinerator as claimed in claim 1 wherein the incinerator further comprises a slag outlet positioned to permit gravitational flow of molten slag from the combustion chamber, and means associated with said first inlet for adding a synthetic slag to said waste products and primary air.

12. A method of burning waste products and the like, comprising the steps of:

providing a combustion chamber having a side wall which is substantially symmetrical about an axis, end walls attached to respective ends of the side wall, a discharge outlet in one of said end walls substantially concentrically about the axis, and first and second inlets adjacent respective said end walls for creating two distinct converging vortical flows in the chamber;

directing waste products and primary air through said first inlet and into said combustion chamber in a first generally vortical flow path which progresses axially toward the second end wall;

directing secondary fuel and secondary air through said second inlet into said second combustion chamber in a second vortical flow path which progresses axially toward the first end wall of the combustion chamber and which flow path moves about the axis in the same direction as said first flow path;

igniting said secondary fuel to cause combustion adjacent said second end wall;

permitting the flow paths to meet intermediate the end walls thereby creating an inward radial flow path where the major portion of the combustion of the waste products takes place, the products of combustion then moving axially within the first fluid path before leaving the combustion chamber through said discharge outlet, and the waste products and primary air being heated as they move towards the radial flow path by the products of combustion leaving the radial flow path.

13. A method as defined in claim 12 including the step of adjusting the axial position of the radial flow path.

14. A method of removing particulates and the like from a fluid, comprising the steps of:

providing a chamber having at least one side wall disposed concentrically about a longitudinal axis and having transverse first and second end walls attached to respective ends of the side wall, a discharge outlet being situated in one end wall concentrically about said axis, first and second inlets adjacent respective end walls, and a particulate collection chamber attached to the side wall intermediate said first and second end walls;

directing a particulate carrying fluid into the chamber through the said first inlet in a first generally vortical flow path which progresses axially towards said second inlet;

directing a control fluid through said second inlet into the chamber in a second generally vortical flow path which progresses axially to meet said first mentioned flow path and which moves about the axis in the same direction, to thereby create a localised inwardly directed radial flow and an annular quiescent zone about the radial flow;

permitting the flow paths to combine into a single flow path in the radial flow, the single flow path then continuing from the radial flow to move axially towards and out through said discharge outlet;

controlling the energy flow rate of the particulate carrying fluid and the control fluid to adjust the axial position of both the quiescent zone and the associated radial flow so that the quiescent zone is aligned with the particulate collection outlet; and removing the collected particulates from the quiescent zone and the separation chamber.

15. A method for removing particulates and the like from a liquid, comprising the steps of:

providing a chamber having a side wall disposed concentrically about a vertical longitudinal axis and having first and second end walls attached to respective ends of the side wall, a discharge outlet mounted in the upper end wall concentrically about said axis, first and second inlets adjacent said first and second end walls respectively, a first particulate collection outlet in said first end wall, a second particulate outlet in said side wall intermediate the first and second end walls;

directing a particulate carrying fluid into said chamber through said first inlet in a first flow path which is generally vortical and progresses axially upwards;

permitting the heavier particulates to fall under the influence of gravity through said first particulate outlet;

directing a control fluid through said second inlet into the chamber in a second generally vortical flow path which moves in the same direction about the axis as the first flow path and progresses downwardly to meet the first mentioned flow path thereby creating a localised inward radial flow and an annular quiescent zone about the radial flow, the flow paths combining into a single flow path in the radial flow, said signal flow path then continuing from the radial flow to move axially towards and through said discharge outlet; and controlling the energy flow rate of at least one of the particulate carrying fluids and the control fluid to thereby adjust the axial position of the quiescent zone and the radial flow so that the quiescent zone is aligned with the second particulate collection outlet for collecting the intermediate particulates of the quiescent zone and removing them from the separator while the light particulates are carried out through the discharge outlet.

* * * * *